US009675832B2

(12) United States Patent
Chen et al.

(10) Patent No.: US 9,675,832 B2
(45) Date of Patent: Jun. 13, 2017

(54) INTERCHANGEABLE RESISTANCE TUBE ASSEMBLY

(71) Applicant: Prism Fitness, Inc., Verona, WI (US)

(72) Inventors: Weng Kin Chen, Shanghai (CN); William J. Sotis, Fitchburg, WI (US)

( * ) Notice: Subject to any disclaimer, the term of this patent is extended or adjusted under 35 U.S.C. 154(b) by 0 days.

(21) Appl. No.: 14/987,301

(22) Filed: Jan. 4, 2016

(65) Prior Publication Data

US 2016/0193490 A1 Jul. 7, 2016

Related U.S. Application Data

(60) Provisional application No. 62/100,469, filed on Jan. 6, 2015.

(51) Int. Cl.

| | |
|---|---|
| ***A63B 21/00*** | (2006.01) |
| ***A63B 21/02*** | (2006.01) |
| ***A63B 23/12*** | (2006.01) |
| ***A63B 21/055*** | (2006.01) |
| *A63B 71/00* | (2006.01) |
| *A63B 21/002* | (2006.01) |
| *A63B 71/06* | (2006.01) |

(52) U.S. Cl.

CPC .. *A63B 21/00061* (2013.01); *A63B 21/00043* (2013.01); *A63B 21/00065* (2013.01); *A63B 21/026* (2013.01); *A63B 21/0552* (2013.01); *A63B 21/0557* (2013.01); *A63B 21/4035* (2015.10); *A63B 23/12* (2013.01); *A63B 21/0023* (2013.01); *A63B 23/1209* (2013.01); *A63B 23/1245* (2013.01); *A63B 71/0054* (2013.01); *A63B 2071/0625* (2013.01); *A63B 2071/0655* (2013.01); *A63B 2208/0204* (2013.01)

(58) Field of Classification Search

CPC ..... A93B 21/00
USPC ..... 482/49, 121, 126
See application file for complete search history.

(56) References Cited

U.S. PATENT DOCUMENTS

| | | | |
|---|---|---|---|
| 3,843,119 | A | 10/1974 | Davis |
| 4,257,592 | A | 3/1981 | Jones |
| 4,909,505 | A | 3/1990 | Tee |
| 5,351,365 | A | 10/1994 | Hauck |
| 5,549,532 | A | 8/1996 | Kropp |

(Continued)

FOREIGN PATENT DOCUMENTS

| | | |
|---|---|---|
| CN | 204073236 | 1/2015 |

OTHER PUBLICATIONS

"Smart Quick Switch Handle" sold by Prism Fitness Group, Madison, WI.

*Primary Examiner* — Jerome W Donnelly
(74) *Attorney, Agent, or Firm* — Stiennon & Stiennon

(57) ABSTRACT

A handle assembly base has a central tube opening for receiving an elastic resistance tube with an expanded end diameter. A first block and a second block are pivotably mounted to the base on opposite sides of the central tube opening. When pivoted towards each other, the blocks define a reduced area opening through which the expanded end diameter of the resistance tube cannot pass, thereby retaining the resistance tube to the base. The base has two opposed ears which extend upwardly of the central tube opening. A flexible strap is secured to the ears, and extends through a cylindrical tube to which a flexible handle cushion is mounted to provide a grip for the user to engage the handle.

20 Claims, 3 Drawing Sheets

(56) References Cited

U.S. PATENT DOCUMENTS

| | | | | |
|---|---|---|---|---|
| 5,665,040 | A * | 9/1997 | Ho | A63B 21/0004 482/121 |
| 5,807,214 | A | 9/1998 | Riazi | |
| 5,885,196 | A | 3/1999 | Gvoich | |
| 6,923,750 | B1 | 8/2005 | Hinds | |
| 7,377,886 | B2 * | 5/2008 | Wu | A63B 21/0004 482/121 |
| 7,578,775 | B2 | 8/2009 | Terry | |
| 7,628,743 | B1 | 12/2009 | Flentye et al. | |
| 7,691,040 | B1 | 4/2010 | Schwinghamer | |
| 7,749,140 | B1 | 7/2010 | Lindemeier et al. | |
| 7,798,945 | B2 * | 9/2010 | Ko | A63B 21/0004 482/121 |
| 8,043,197 | B2 | 10/2011 | Hetrick | |
| 2006/0105893 | A1 | 5/2006 | Chen | |
| 2011/0312477 | A1 | 12/2011 | Wiseman | |

* cited by examiner

INTERCHANGEABLE RESISTANCE TUBE ASSEMBLY

CROSS REFERENCES TO RELATED APPLICATIONS

The application claims the benefit of priority of U.S. provisional patent App. No. 62/100,469, filed Jan. 6, 2015, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present disclosure generally pertains to exercise and medical rehabilitation apparatus, and more particularly, to resistance tubes used for fitness, exercise, and medical rehabilitation. Some examples of resistance tubes according to the present disclosure may be used for fitness training to tone muscle and increase strength, while others may be used for physical rehabilitation following injury or medical procedures.

Resistance bands or tubing comes in multiple elasticities to provide a selection of varying weights and sizes. Oftentimes, a handle is permanently affixed on each end of the tubing, and each weight and size of resistance tube has its own set of handles. Additionally, straps or alternative attachment means may be used instead of handles to attach to appendages such as ankles and arms.

Some handles allow for interchanging of fitness resistance tubing. Some handles include a cutout for resistance tubing and resistance tubing stretched to fit the tubing in place within the handle. Other handles include sliding mechanisms to slide one side of the handle up and down to place the tubing within the housing. However, these systems may not securely and safely hold resistance tubing in place, and may be time consuming and difficult to exchange tubing.

It is therefore advantageous to have an apparatus, device, and system that enables secure and safe hold of resistance tubing while having a configuration for quick and easy exchange, insertion and removal of resistance tubing. The apparatus, device, and system of the disclosure can be used in multiple fields, including fitness, exercise, and therapy. Other fields include, but are not limited to the medical, construction, and industrial fields.

SUMMARY OF THE INVENTION

The exercise apparatus of this invention has a handle assembly which releasably engages a resistance tube. The handle assembly has a base with a central tube opening. A first flap or block and a second flap or block are pivotably mounted to the base on opposite sides of the central tube opening. When pivoted towards each other, the blocks compress a resistance tube which is passed through the central opening and secure it in place. The base has two opposed ears which extend upwardly of the central tube opening. A flexible strap is secured to the ears, and extends through a cylindrical tube to which a flexible handle cushion is mounted.

An alternative embodiment handle assembly has a base with three pairs of blocks pivotably mounted thereto. Each pair of blocks is positioned on opposite sides of a separate tube opening, and is adjustable to secure an end of a resistance tube in place.

An exercise regimen process is provided by selecting a resistance tube handle having a handle assembly, a base, and a first block and a second block pivotably mounted to the base. At least one resistance tube is selected, followed by positioning the first and second block in an open position. The resistance tube is then inserted through the base and the blocks are closed, followed by pulling the resistance tube into a seated position. A user may then increase and decrease the resistance on the resistance tube handle for a selected exercise regimen.

Additionally, a user may then increase and decrease the resistance on the resistance tube handle for a selected exercise regimen by interchanging the resistance tube with one of another resistance level, and/or by adding or subtracting resistance tubes where there is a multiple pocket handle base.

It is an object of the present invention to provide a handle for securely gripping a resistance tube end which is readily released to permit changing of one resistance tube for another.

Further objects, features and advantages of the invention will be apparent from the following detailed description when taken in conjunction with the accompanying drawings.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope. The disclosure will be described with additional specificity and detail through use of the accompanying drawings.

DESCRIPTION OF THE PREFERRED EMBODIMENTS

Figure 1:
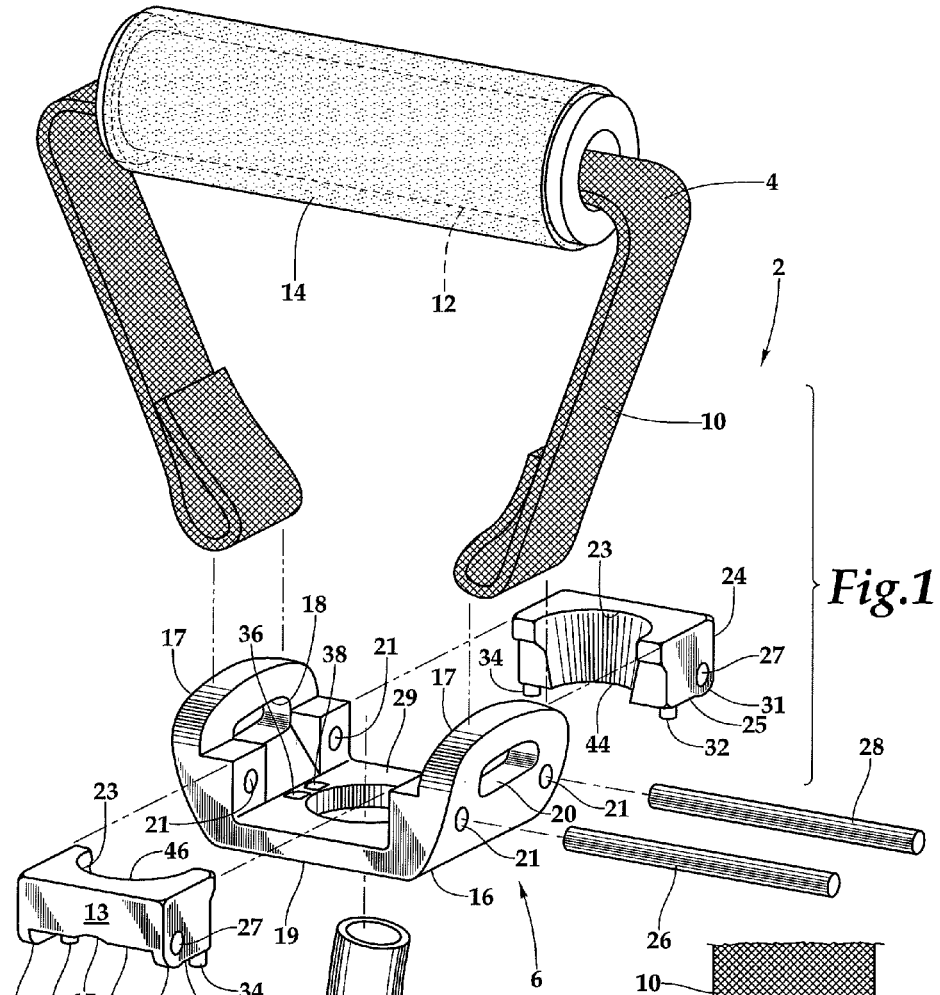
FIG. 1 is an exploded isometric view of a single tube apparatus of the present invention.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

Figure 2:
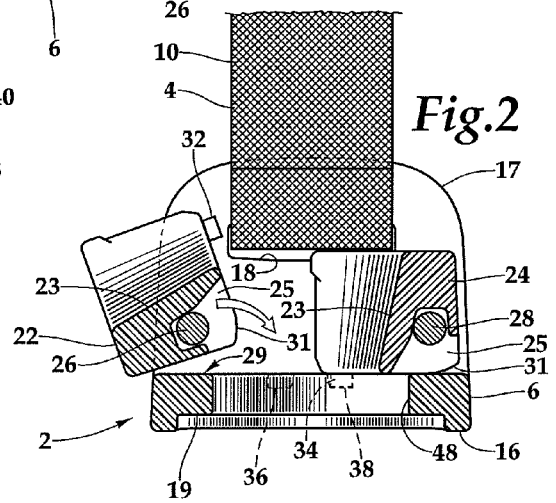
FIG. 2 is a cross sectional view of the apparatus of FIG. 1.

Referring to FIGS. 1 and 2, an apparatus 2 is shown with a handle assembly 4 and tube assembly 6, which engages a resistance tube 8 in the locked position. The handle assembly 4 includes a grip member or strap 10, handle tube 12, and handle cushion 14. The tube assembly includes a base 16 with protruding ears 17 with openings 18, 20 which define a pair of strap connectors 18, 20. Two pivoting blocks or flaps 22, 24 are mounted by rods 26, 28 to the base 16 on opposite sides of a central opening 48 formed in a bottom wall 19 of the base 16.

Figure 6:
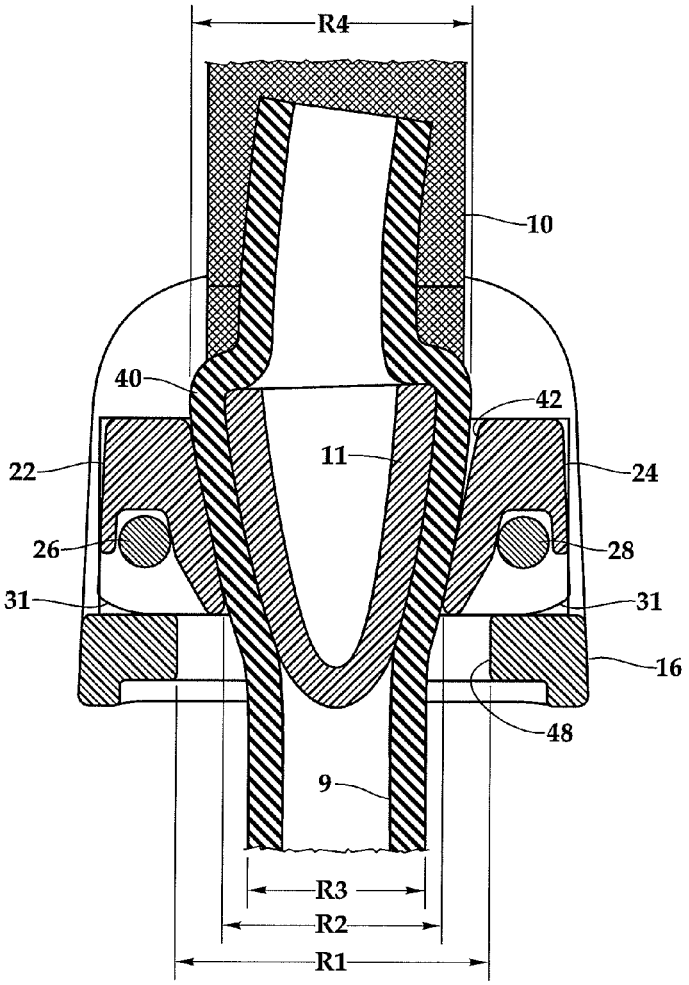
FIG. 6 is a cross-sectional view of the apparatus of FIG. 4 showing the resistance tube engaged therein.

As best shown in FIG. 6, the resistance tube 8 is of a conventional type having an elastic cylindrical tube 9 having a uniform exterior diameter. The ends of the tubes 8 are made larger in diameter by rigid conical end inserts 11 which are received within the tube 9 and which form the tubes to have an expanded end diameter.

The base central opening 48 allows the resistance tube 8 to pass through the base 16. The blocks 22, 24 are movable by the user's fingers between an open position, in which the wider end of a tube 8 can be passed through the central opening 48, and a closed position, in which the blocks define an opening which is smaller than the central opening and in which the wider end of the tube is retained on the handle.

As shown in FIG. 2 the blocks 22, 24 may be identical, and each block has an inside wall 23 which has a concave inner surface 50 which may define a portion of a cone. Each block inside wall 23 extends between two end walls 25 which are perpendicular to the axis of the rod 26, 28 about which the block rotates. The base bottom wall 19 has a planar upper surface 29. Each block end wall 25 has a curved inner cam surface 31 which is spaced from the bottom wall upper surface 29 in the open position, and which engages the bottom wall upper surface in the closed position. This engagement provides some resistance to moving the block to the open position, and thereby assists in retaining the first block in the closed position.

The base 16 includes a connection means for the rods 26, 28 comprising shaft openings 21 in the sides of the base 16 and which engage and tightly maintain the position of the rods 26, 28. The shaft openings 21 are spaced above and parallel to the base bottom wall upper surface 29. The rods 26, 28 pass through openings 27 formed in the end walls 25 of the blocks 22, 24. With the rods press fit in the openings 21 of the base, and the blocks mounted on the rods, the blocks 22, 24 are free to hinge or rotate about the axes defined by the rods 26, 28. Each block 22, 24 has two locking tabs 32, 34, shown in FIG. 2, which project below the block inside walls. The tabs 32, 34 fit into respective locking recesses 36, 38 which extend below the upper surface of the base 16 bottom wall. The rotation of the blocks into the closed position extends the locking tabs 32, 34 into the recesses 36, 38, thereby maintaining the blocks 22, 24 in the closed position. The locking tabs 32, 34 meet the locking recesses 36, 38 with a friction or snap fit, and the engagement preferably gives an audible or tactile signal to the user that the block has fully seated in the closed position to assure the user that the handle is now prepared to engage an attached resistance tube 8.

The strap 10 is connected to the base 16 at the strap connectors 18, 22 and passes through the handle tube 12. The strap 10 is constructed of durable materials suitable for strength, tension and resistance, which are known in the art. The handle tube 12 is constructed of suitable lightweight materials, such as high strength plastics or metals, for durability and strength suitable for high resistance and tension. The handle cushion 14 is constructed of a durable lightweight material with comfort and grip friction, suitable materials are known in the art, including various foams and rubber materials. Antibacterial resistance materials may also be utilized.

The handle apparatus 2 provides a system for exercising with linear components, such as resistance tubing, while providing efficient options for interchangeability. Such linear accessories may be interchangeable so that only one set of handles is required. The user can change between different sizes and weights of resistance tubing to perform multiple exercises.

The tube 8 has a semi-conical end 40 for placement between the closed blocks 22, 24. The blocks 22, 24 form an inner semi-conical shaped orifice 42 when in the closed position, with a first edge 44 and second edge 46, the second edge 46 forming a larger orifice than that formed by the first edge 44. The handle 2 securely holds the tube 8. During use, as axial force increases on the tube 8, the tube 8 is drawn tighter within the handle 2, to provide for a safe exercise apparatus.

The base 16 and blocks 22, 24 may be made of a variety of materials known in the art for lightweight, strong, and high impact performance, such as various extruded plastics and metal alloys. Each set of blocks 22, 24 may also be referred to as a "pocket" when the blocks 22, 24 are in the closed position. A multiple "pocket" base 16 having three pockets is shown in FIGS. 3-6. It is contemplated that a multiple pocket base has two or more pockets.

Figure 3:
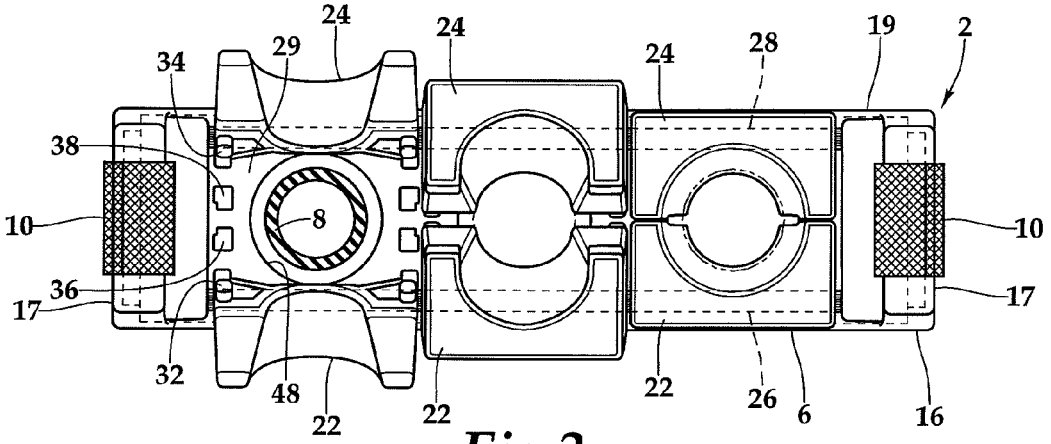
FIG. 3 is a top plan view of a triple tube apparatus of the present invention, with one set of blocks shown in an open position, one in a partially closed position, and one in a locked position.
Figure 4:
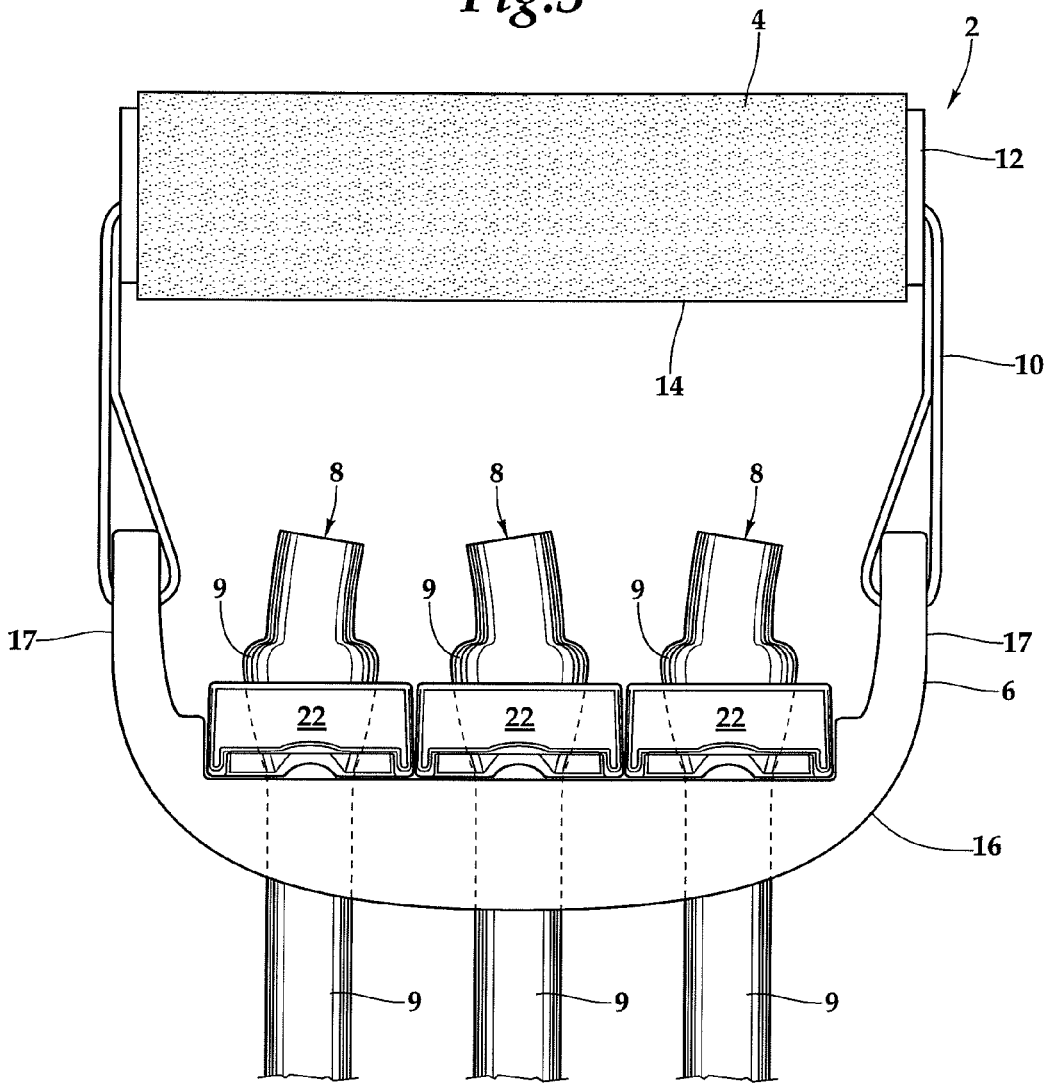
FIG. 4 is a side elevational view of the triple tube apparatus of FIG. 3.
Figure 5:
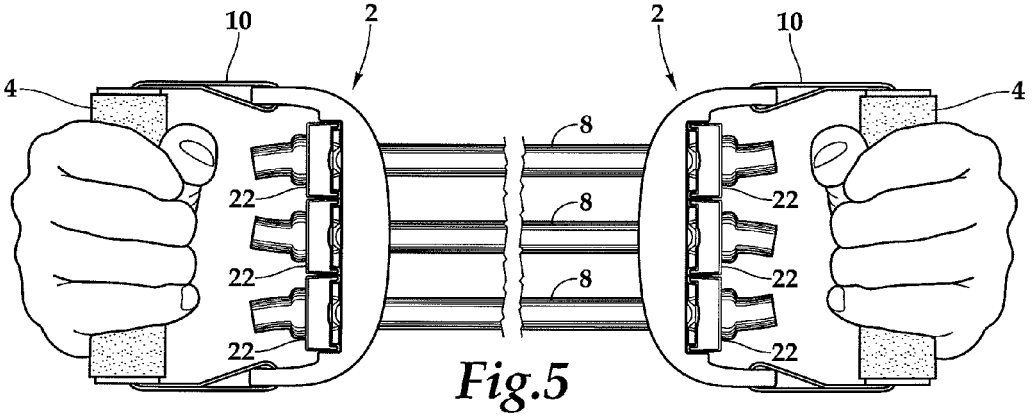
FIG. 5 is a side elevational view of two triple tube apparatus of FIG. 3 in use, with resistance tubes extending therebetween.

As shown on the right of FIG. 3, the blocks 22, 24 in an open position allow the semiconical end of a resistance tube to pass through the tube central opening 48. To give maximum clearance around the central opening 48 in the base 16, the blocks 22, 24, may be provided with a semicircular relief 15 formed in an outside wall 13 which extends between the end walls 25, as shown in FIG. 1. The user may select the resistance tube 8 of preference, or a combination of more than one resistance tubes 8. In the embodiment of FIGS. 3-6, three sets of blocks 22, 24 are configured to receive resistance tubes 8. However, it is contemplated that a single assembly (such as shown in FIG. 1), a double assembly (not shown), or an apparatus configured to receive more than three tubes may be constructed. After selecting single or multiple resistance tubes 8, the user inserts each tube 8 through a central opening 48 in the bottom of the base 16 such that the semi-conical end 40 extends beyond the open blocks 22, 24.

The user then rotates or hinges the blocks 22, 24 about the rods 26, 28 to a closed position as shown on the left of FIG. 3, the locking tabs 32, 34 meeting the locking recesses 36, 38. The tube 8 is then partially pulled through the orifice 42 formed by the closed blocks 22, 24 to a position wherein the inner semi-conical surfaces 50 of the inside walls of the blocks 22, 24 meet the semi-conical end of the tube 8. The tube 8 is then safely seated within the block orifice 42, at which point the user may choose to add another resistance tube 8, or begin an exercise regimen using the apparatus 2. During use, as axial force increases on the tube 8, the tube 8 is drawn tighter within the handles 2, to provide for a safe exercise system.

When the blocks 22, 24 are in the closed position, the handle assembly 4 can be alternatively viewed as having a semi-circular and semi-conical groove for seating a similarly shaped outer surface of a resistance tube. Alternatively, the closed block pair formation can be viewed as a u-shaped or v-shaped bracket for seating a similarly shaped outer surface of a resistance tube (not shown).

In an alternative embodiment, the tube end may be semi-pyramidically shaped with three or four edges (not shown) with the block orifice having the corresponding semi-pyramidical shape for receiving the semi-pyramidically shaped resistance tube. Alternatively, the resistance tube end may be a semi wedge-shaped having two or more edges, and the block orifice having a corresponding semi wedge shape for receiving the semi wedge-shaped resistance tube.

In an alternative embodiment (not shown), more than one block 22 and more than one block 24 are connected in series. By example, an apparatus 2 is configured to receive three exercise tubes in which three blocks 22 hinge together and three blocks 24 hinge together. Alternatively, two sets of blocks 22 can operate together and a third block 22 operates independent of the pair, and two sets of blocks 24 can operate together and a third block 22 operates independent of the pair. Alternatively, any combination of independent and in-series block operation is contemplated for apparatus 2 having two or more block pairings 22, 24.

The triple tube apparatus 2 of FIGS. 3-6 has three sets of blocks 22, 24. The blocks in FIG. 3 are shown in open, semi-open, and closed positions. Each of the blocks 22 rotates independent of the other blocks 24, and each set of blocks 22, 24 operates independent of the other sets. The user may select resistance tubes of the same or varying resistance. For example, Smart fitness cables available from Prism Fitness Group have a multitude of resistance levels ranging from 10-100 pound resistance levels. A user may select a light, medium, and heavy resistance tube to have a customized exercise regimen. The user may then open the blocks 22, 24 holding the light resistance tube, remove it, and replace it with a medium resistance tube to increase the overall amount of resistance for the user's particular exercise regimen. Removal and replacement is performed quickly and safely, allowing the user to avoid injury and perform efficient exercise routines.

The relationship between the resistance tube and the apparatus 2 is indicated in FIG. 6. The first block 22 pivots about a first axis defined by a first rod 26, and the second block 24 pivots about a second axis defined by the second rod 28. The first axis is parallel to the second axis, with the central opening 48 positioned between the first axis and the second axis. The central opening 48 has a maximum dimension R1, which in the illustrated embodiment corresponds to the diameter of a circular through hole. This maximum dimension is measured in a plane parallel to a plane extending through the first axis and the second axis, i.e., in the plane of the upper surface 29 of the base.

The first block 22 and the second block 24 are pivotable between an open position and a closed position. In the closed position, the inside walls 23 of the first block 22 and the second block 24 face each other to define a through hole 42 extending between the first block and the second block and communicating with the base central opening 48. The through hole 42 defined between the first block inside wall and the second block inside wall has a second minimum dimension R2 measured in a plane parallel to the plane extending through the first axis and the second axis, i.e, in a plane directly above the upper surface 29 of the base. In the illustrated embodiment, the through opening approximates a converging frustoconical surface, which converges to its narrowest point directly above the upper surface of the base. This second minimum dimension is less than the first maximum dimension, such that a resistance tube having a main diameter R3 and a larger expanded end diameter R4 can extend through the base central opening 48 when the first block 22 and second block 24 are in the open position, and the resistance tube 8 expanded end diameter is retained against passing through the central opening when the first block and the second block are in the closed position. In other words, the main diameter R3 is less than R1, and the expanded end diameter R4 of the resistance tube is greater than R2.

Various alternatives are contemplated as being within the scope of the following claims, particularly pointing out and distinctly claiming a subject matter regarded as the invention.

We claim:

1. A resistance tube handle comprising:

a base having portions defining a central opening;

a first ear extending from the base on a first side of the central opening;

a second ear extending from the base on a second side of the central opening spaced from the first side;

a flexible strap which extends above the central opening and which is connected to the first and second ear;

a first block pivotably connected to the base to pivot about a first axis;

a second block pivotably connected to the base to pivot about a second axis, wherein the first axis is parallel to the second axis, and the central opening is positioned between the first axis and the second axis, and wherein each of the first block and the second block have portions defining an inside wall, the first block and the second block being pivotable between an open position and a closed position, wherein in the closed position, the inside walls of the first block and the second block face each other to define a through hole extending between the first block and the second block and communicating with the base central opening, and wherein the base central opening has a first maximum dimension measured in a plane parallel to a plane extending through the first axis and the second axis, and wherein the through hole defined between the first block inside wall and the second block inside wall has a second minimum dimension measured in a plane parallel to the plane extending through the first axis and the second axis, the second minimum dimension being less than the first maximum dimension, such that a resistance tube having a main diameter and a larger expanded end diameter can extend through the base central opening when the first block and second block are in the open position, and the resistance tube expanded end diameter is retained against passing through the central opening when the first block and the second block are in the closed position.

2. The resistance tube handle of claim 1 wherein the first block and the second block inside walls define portions of a conical surface.

3. The resistance tube handle of claim 1 wherein the first block has a projection extending below the inside wall, and wherein the base has a depression positioned to receive the first block projection therein in a snap fit engagement when the first block is in the closed position.

4. The resistance tube handle of claim 1 wherein a first rod is mounted to the base, and wherein the first block is mounted to the rod to thereby rotate about the first axis.

5. The resistance tube handle of claim 1 wherein the base has a second opening spaced from the central opening, and further comprising:

a third block pivotably mounted to the base to rotate about the first axis; and a fourth block pivotably mounted to the base to rotate about the second axis, wherein the third block and fourth block are positioned above the second opening and are pivotable between an open position and a closed position, to engage a second resistance tube to the base.

6. The resistance tube handle of claim 1 wherein the base has a bottom wall in which the central opening is formed, and wherein the bottom wall has an upper surface, and wherein the first block has an end wall perpendicular to the first axis, and the end wall has an inner cam surface which is spaced from the bottom wall upper surface in the open position, and which engages the bottom wall upper surface in the closed position to thereby assist in retaining the first block in the closed position.

7. A handle for engaging a resistance tube having a main diameter and a larger expanded end diameter; the handle comprising:

a base having portions defining a central opening;

a first ear extending from the base on a first side of the central opening;

a second ear extending from the base on a second side of the central opening spaced from the first side;

a grip member which extends above the central opening and which is connected to the first and second ear;

a first block pivotably connected to the base to pivot about a first axis;

a second block pivotably connected to the base to pivot about a second axis, wherein the central opening is positioned between the first axis and the second axis, and wherein each of the first block and the second block have portions defining an inside wall, the first block and the second block being pivotable between an open position and a closed position, wherein in the closed position of the blocks, the inside walls of the first block and the second block face each other to define a through hole extending between the first block and the second block and communicating with the base central opening, wherein the through hole has a minimum opening area which is smaller than an opening area of the base central opening, such that the expanded end diameter of the resistance tube can extend through the base central opening when the first block and second block are in the open position, and the resistance tube expanded end diameter is retained against passing through the central opening when the first block and the second block are in the closed position.

8. The resistance tube handle of claim 7 wherein the first block and the second block inside walls define portions of a conical surface.

9. The resistance tube handle of claim 7 wherein the first block has a projection extending below the inside wall, and wherein the base has a depression positioned to receive the first block projection therein in a snap fit engagement when the first block is in the closed position.

10. The resistance tube handle of claim 7 wherein, a first rod is mounted to the base, and wherein the first block is mounted to the rod to thereby rotate about the first axis.

11. The resistance tube handle of claim 7 wherein the base has a second opening spaced from the central opening, and further comprising:

a third block pivotably mounted to the base to rotate about the first axis; and a fourth block pivotably mounted to the base to rotate about the second axis, wherein the third block and fourth block are positioned above the second opening and are pivotable between an open position and a closed position, to engage a second resistance tube to the base.

12. The resistance tube handle of claim 7 wherein the base has a bottom wall in which the central opening is formed, and wherein the bottom wall has an upper surface, and wherein the first block has an end wall perpendicular to the first axis, and the end wall has an inner cam surface which is spaced from the bottom wall upper surface in the open position, and which engages the bottom wall upper surface in the closed position to thereby assist in retaining the first block in the closed position.

13. A resistance tube exercise device comprising:

a resistance tube having a main diameter and a larger expanded end diameter;

a handle base having portions defining a central opening;

a grip member connected to the handle base; and a first block pivotably connected to the base to pivot about a first axis, wherein the central opening is positioned inward of the first axis, and wherein the first block has portions defining an inside wall, the first block being pivotable between an open position and a closed position, wherein in the open position the expanded end diameter of the resistance tube passes through the central opening beyond the first block, and wherein in the closed position the inside wall of the first block projects over the base central opening to restrict the opening and retain the expanded end diameter of the resistance tube from passing through the central opening, to thereby hold the resistance tube in connection with the handle base when a force is applied to the resistance tube in one direction while a force is applied to the grip member in an opposed direction.

14. The resistance tube exercise device of claim 13 further comprising;

a first ear extending from the base on a first side of the central opening;

a second ear extending from the base on a second side of the central opening spaced from the first side; and a grip member which extends above the central opening and which is connected to the first and second ear.

15. The resistance tube exercise device of claim 13 further comprising a second block pivotably connected to the base to pivot about a second axis, and positioned across the central opening from the first block, the second block being pivotable about the second axis between an open position and a closed position, wherein in the closed position the first block and the second block define an opening communicating with the central opening which is narrower than the resistance tube expanded end diameter.

16. The resistance tube exercise device of claim 15 wherein the second block has an inside wall, and wherein the first block and the second block inside walls define portions of a conical surface.

17. The resistance tube exercise device of claim 15 wherein a first rod is mounted to the base, and wherein the first block is mounted to the rod to thereby rotate about the first axis, and a second rod is mounted to the base, and the second block is mounted to the second rod to thereby rotate about the second axis.

18. The resistance tube exercise device of claim 13 wherein the first block has a projection thereon, and wherein the base has a depression positioned to receive the first block projection therein in a snap fit engagement when the first block is in the closed position.

19. The resistance tube exercise device of claim 13 wherein the base has a second opening spaced from the central opening, and further comprising:

a second resistance tube having a main diameter and a larger expanded end diameter; and a third block pivotably mounted to the base to rotate about the first axis; and wherein the third block is positioned above the second opening and is pivotable between an open position and a closed position, to engage the second resistance tube to the base.

20. The resistance tube exercise device of claim 13 wherein the base has a bottom wall in which the central opening is formed, and wherein the bottom wall has an upper surface, and wherein the first block has an end wall perpendicular to the first axis, and the end wall has an inner cam surface which is spaced from the bottom wall upper surface in the open position, and which engages the bottom wall upper surface in the closed position to thereby assist in retaining the first block in the closed position.

* * * * *